US008191240B2

(12) United States Patent
Ishido et al.

(10) Patent No.: US 8,191,240 B2
(45) Date of Patent: Jun. 5, 2012

(54) METHOD FOR WINDING LEAD WIRE ON MULTILAYER COIL ELECTRONIC COMPONENTS

(75) Inventors: Yoshimitsu Ishido, Kyoto-fu (JP); Ryo Watanabe, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/100,555

(22) Filed: May 4, 2011

(65) Prior Publication Data

US 2011/0203105 A1 Aug. 25, 2011

Related U.S. Application Data

(63) Continuation of application No. PCT/JP2009/006006, filed on Nov. 11, 2009.

(30) Foreign Application Priority Data

Dec. 12, 2008 (JP) ..... 2008-316450

(51) Int. Cl.
*H01F 7/06* (2006.01)

(52) U.S. Cl. ..... 29/605; 29/592.1; 29/602.1; 29/604; 264/272.11; 336/176; 336/200; 336/212; 336/229; 336/232

(58) Field of Classification Search ..... 29/592.1, 29/602.1, 604, 605; 264/727.11; 336/65, 336/83, 176, 192, 200, 206–208, 212, 220–222, 336/229, 232, 233
See application file for complete search history.

(56) References Cited

U.S. PATENT DOCUMENTS

| | | | | |
|---|---|---|---|---|
| 3,199,178 | A * | 8/1965 | Renskers | 29/602.1 |
| 4,842,352 | A * | 6/1989 | Sasaki et al. | 336/83 |
| 5,923,237 | A * | 7/1999 | Sato et al. | 336/212 |
| 6,535,095 | B2 * | 3/2003 | Aoki et al. | 336/83 |
| 6,717,500 | B2 * | 4/2004 | Girbachi et al. | 336/83 |
| 7,495,538 | B2 * | 2/2009 | Tsunemi et al. | 336/84 M |
| 7,688,173 | B2 * | 3/2010 | Azuma et al. | 336/200 |

FOREIGN PATENT DOCUMENTS

| | | |
|---|---|---|
| JP | 06-318528 | 11/1994 |
| JP | 2000-133522 A | 5/2000 |
| JP | 2002-313646 A | 10/2002 |
| JP | 2005-327876 A | 11/2005 |
| JP | 2007-157946 A | 6/2007 |
| JP | 2008-181963 A | 8/2008 |

OTHER PUBLICATIONS

International Search Report; PCT/JP2009/006006; Feb. 23, 2010.
Written Opinion of the International Searching Authority; PCT/JP2009/006006; Feb. 23, 2010.

* cited by examiner

*Primary Examiner* — Paul D Kim
(74) *Attorney, Agent, or Firm* — Studebaker & Brackett PC; Tim L. Brackett, Jr.; John F. Guay

(57) ABSTRACT

A method for winding a lead wire on a multi-winding electronic component is provided. The method can prevent winding slack of the lead wire, a break of the lead wire, and/or a terminal disconnection failure. A lead wire is wound around a winding core by a certain number of turns to form at least one first layer. Next, the lead wire is folded back toward an electrode, is pulled toward the electrode at an end-of-winding side so as to be across the second layer. Then, the lead wire is caught at a bottom part of the collar to form a final terminal part for boding to the electrode.

8 Claims, 6 Drawing Sheets

METHOD FOR WINDING LEAD WIRE ON MULTILAYER COIL ELECTRONIC COMPONENTS

CROSS REFERENCE TO RELATED APPLICATIONS

The present application is a continuation of International Application No. PCT/JP2009/006006, filed Nov. 11, 2009, which claims priority to Japanese Patent Application No. 2008-316450 filed Dec. 12, 2008, the entire contents of each of these applications being incorporated herein by reference in their entirety.

TECHNICAL FIELD

The present invention relates to a method of winding a lead wire on a multi-winding electronic component.

BACKGROUND

Heretofore, various multi-winding electronic components have been proposed as electronic components used for noise reduction, antennas, choke coils, and impedance matching circuits. The multi-winding electronic components are called coil components that have structures in which coils are wound around winding cores and electrify to produce magnetic fluxes.

For example, a coil component described in Japanese Unexamined Patent Application Publication No. 2005-327876 (hereinafter, "PTL 1") (see, paragraphs 0029 to 0032, 0040, and 0041, FIG. 4, and so on) includes a core that is made of ferrite and that includes a winding core and collars provided at both ends of the winding core. Nickel films serving as electrodes are formed on the collars by an electroless deposition method. A lead wire made of a conductive material is, for example, doubly wound around the winding core and the ends of the lead wire are subjected to thermocompression bonding to the electrodes formed on the collars.

A lead wire is wound, for example, in the following manner in another coil component in related art, as shown in FIGS. 7 to 10.

In a coil component 21 shown in FIG. 7, an end 23*a* at which winding of a lead wire 22 is started is wired on an electrode 25*a* formed on one collar 24*a*, among the collar 24*a* and a collar 24*b* formed at both ends of a winding core 24, and the lead wire 22 is then wound around the winding core 24 toward the other collar 24*b* to form a bottom layer part 28. After the lead wire 22 is wound by a certain number of turns, the lead wire 22 is folded back in a manner shown in FIG. 8 and the lead wire 22 is wound over the bottom layer part 28 by a certain number of turns in a manner shown in FIG. 9 to form an upper layer part 29.

Then, the lead wire 22 is folded back toward an electrode 25*b* formed on the collar 24*b* at a certain position in a manner shown in FIG. 10, an end 23*b* of the lead wire 22 is wired on the electrode 25*b* while being pulled, and the lead wire 22 is subjected to the thermocompression bonding to the electrode 25*a* and the electrode 25*b*.

SUMMARY

This disclosure provides a method of winding a lead wire on a multi-winding electronic component in a way that can prevent winding slack of the lead wire, break of the lead wire, and/or terminal disconnection failure.

In a disclosed embodiment, a method of winding a lead wire on a multi-winding electronic component includes winding the lead wire around a winding core from a first side of the winding core to a second side of the winding core to form a lower winding part, and forming an upper winding part in which the lead wire is wound over the lower winding part from the second side to the first side by a number of turns that is smaller than the total number of turns of the lead wire in the lower winding part. The lead wire is folded back at a predetermined folding-back position toward the second side and the lead wire is wound over the upper winding part. The folded back lead wire is caught at a bottom part of a collar on which the other electrode is formed in the winding core to form a final terminal part.

In a more specific embodiment, the method of winding the lead wire on the multi-winding electronic component may use a winding core having a quadrangular prism shape.

In another more specific embodiment, the method of winding the lead wire on the multi-winding electronic component may include winding the lead wire by at least one quarter turn from the predetermined folding-back position.

In yet another more specific embodiment, the method of winding the lead wire on the multi-winding electronic component may use a winding core having a column shape.

In another more specific embodiment, the method of winding the lead wire on the multi-winding electronic component may include winding the lead wire by about one turn from the predetermined folding-back position.

In still another more specific embodiment, the method of winding the lead wire on the multi-winding electronic component may include, prior to catching the lead wire, winding the lead wire around a portion of the winding core between an end-of-winding part of the lower winging part and the collar at the second end where the winding core is bare.

DETAILED DESCRIPTION

Figure 10:
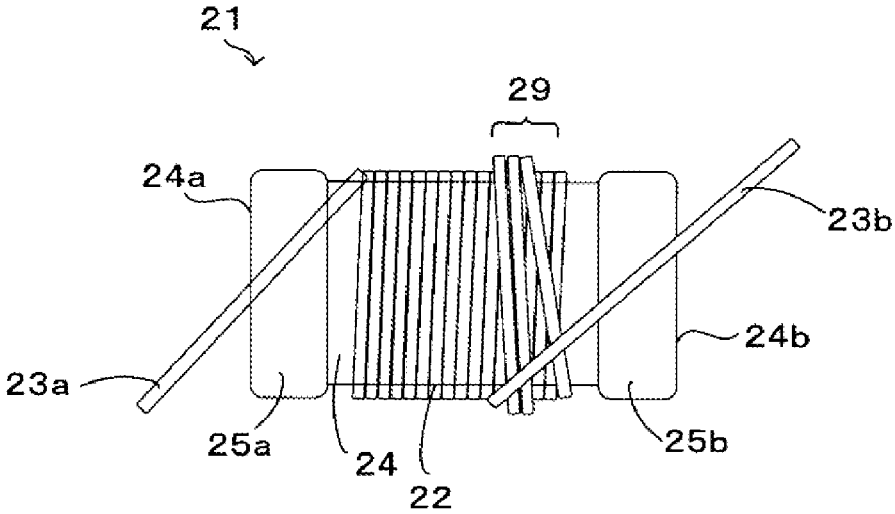
FIG.10 Prior Art
FIG. 10 is a diagram illustrating the winding process of the lead wire on the chip coil in the related art.

The inventors have realized that in the method of winding the lead wire described with respect to the coil component described in PTL 1, because the lead wire 22 is directly pulled from the part where the lead wire 22 is folded back to be subjected to the thermocompression bonding to the electrode 25*b* for fixing, as shown in FIG. 10, the lead wire is apt to be removed from the part where the lead wire 22 is folded back. This can cause winding slack and an error in product specification dimension in which the product is increased in size as a result of the winding slack. In addition, a stress can be applied on the lead wire 22 at the part where the winding slack occurs and cause the lead wire 22 to break.

Furthermore, the inventors realized that the position where the lead wire 22 is folded back is varied depending on the apparatus or the equipment. Accordingly, when the position where the lead wire 22 is folded back is apart from the electrode 25*b*, the lead wire 22 is wired for a longer distance to be directly fixed on the electrode 25*b*. As a result, the wired lead wire 22 is apt to be uncoiled in the direction of the folding-back position to cause terminal disconnection failures including insufficient arrangement of the lead wire 22 to be subjected to the thermocompression bonding on the electrode 25*b* and/or disconnection of the lead wire 22 that have been subjected to the thermocompression bonding from the electrode 25*b*.

Figure 1:
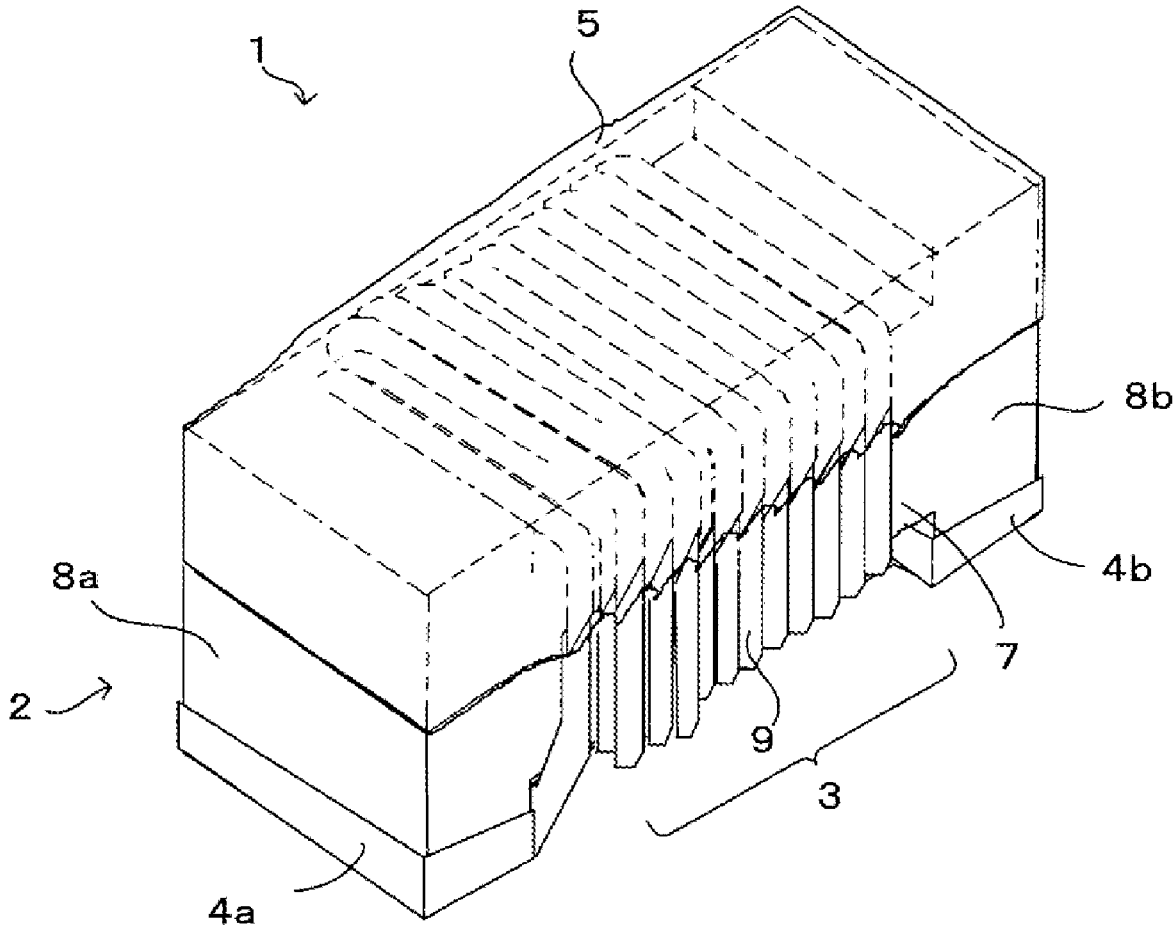
FIG. 1 schematically shows the structure of a chip coil according to an exemplary embodiment.
Figure 2:
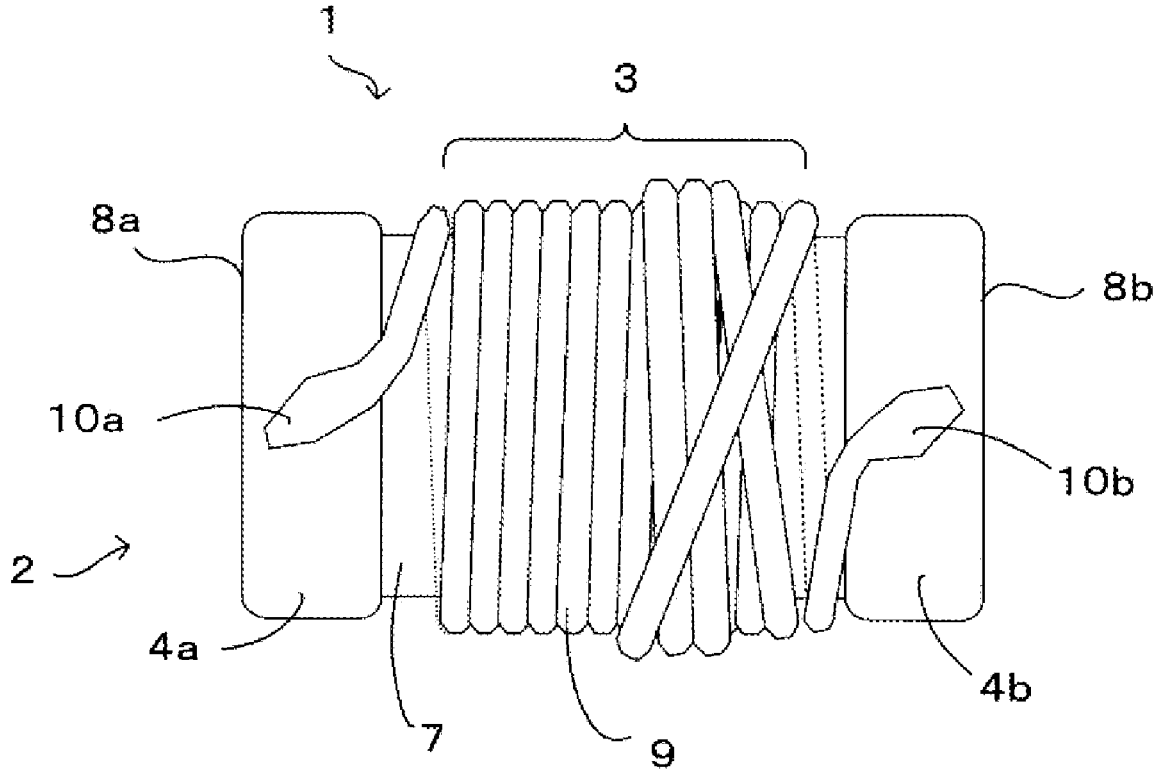
FIG. 2 is a bottom view of the chip coil shown in FIG. 1.

Exemplary embodiments are now described with reference to FIGS. 1 to 6. More specifically, an exemplary method of winding a lead wire on a chip coil 1, which is a multi-winding electronic component, is now described. FIGS. 1 and 2 schematically show the structure of the chip coil 1. FIGS. 3 to 6 are diagrams illustrating a winding process of the lead wire on the chip coil 1. FIGS. 2 to 6 are schematic diagrams of the chip coil 1, as viewed from a face (bottom face) where the chip coil 1 is mounted on a mounting board.

FIG. 1 shows a structure of chip coil 1 according to an exemplary embodiment. As shown in FIG. 1, chip coil 1 includes a core 2, a winding part 3, electrodes 4*a* and 4*b*, and a resin layer 5.

The core 2 is made of a material such as alumina or ferrite and includes a winding core 7 and collars 8*a* and 8*b* at both ends of the winding core 7, as shown in FIG. 1. The winding core 7 can have a quadrangular prism shape that is long in one direction. The collars 8*a* and 8*b* each can have a rectangular parallelepiped shape. The winding core 7 is formed integrally with the collars 8*a* and 8*b*.

As shown in FIG. 2, the electrodes 4*a* and 4*b* can be made of tin and formed on bottom faces of the collars 8*a* and 8*b*, respectively, although electrodes 4*a* and 4*b* can be formed on a face of the collars 8*a* and 8*b* other than the bottom face of the collars 8*a* and 8*b*.

The winding part 3 is formed by winding a lead wire 9 made of a conductive material around the winding core 7 by a multiple number of turns. The lead wire 9 can have, for example, a diameter of 20 μm to 100 μm. As shown in FIG. 2, ends 10*a* and 10*b* of the lead wire 9 in the winding part 3 can be subjected to thermocompression bonding to attach the ends 10*a*, 10*b* to the electrodes 4*a* and 4*b* on the collars 8*a* and 8*b*, respectively.

The resin layer 5 is made of non-conductive resin, such as ultraviolet (UV) cured resin, and is formed so as to cover a top face of the chip coil 1 from one collar 8*a* to the other collar 8*b*. The dimensions of the chip coil 1 can be, for example, 7.4 mm×2.0 mm×1.9 mm, although the chip coil 1 can have other dimensions appropriate for an application.

Next, a method of winding a lead wire on the chip coil 1 will be described with reference to FIGS. 3 to 6. The left side in the drawings is a side at which the winding of the lead wire 9 is started (i.e., a start-of-winding side) and the right side therein is a side at which the winding of the lead wire 9 is terminated (i.e., an end-of-winding side), in each of FIGS. 3 to 6.

First, the core 2 is prepared. The electrodes 4*a* and 4*b* made of tin are formed in advance on the collars 8*a* and 8*b*, respectively, of the core 2. An end 15*a* at the start-of-winding side of the lead wire 9 is wired on the electrode 4*a*.

Figure 3:
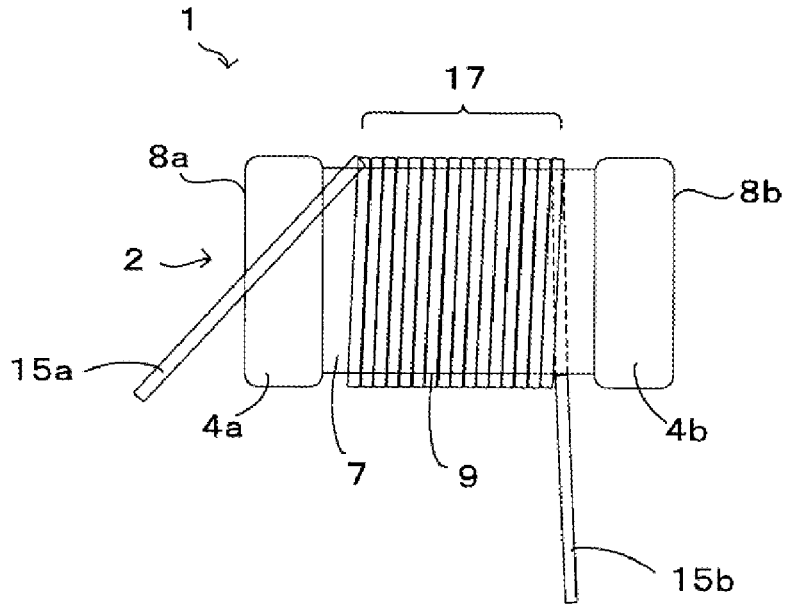
FIG. 3 is a diagram illustrating a winding process of a lead wire on the chip coil shown in FIG. 1.

Next, the core 2 is rotated around the axis of the core 2 while the lead wire 9 is being pulled toward the electrode 4*b* at the end-of-winding side. Then, as shown in FIG. 3, the lead wire 9 is wound around the winding core 7 by a certain number of turns while the lead wire 9 is being aligned toward the electrode 4*b* at the end-of-winding side to form a first layer 17. At this time, a portion of a length of about 20 μm to 100 μm, where the lead wire 9 is not wound and where the winding core 7 is bare, remains between the end-of-winding part of the first layer 17 and the collar 8*b*. The first layer 17 corresponds to a lower winding part in the present invention. The lower winding part is not limited to one layer and may include multiple layers. For example, the lower winding part may include about five layers.

Figure 4:
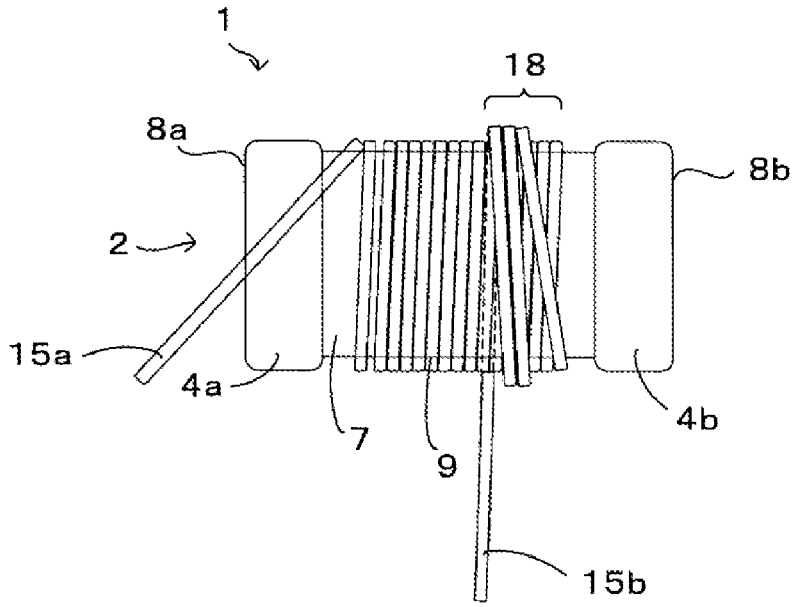
FIG. 4 is a diagram illustrating the winding process of the lead wire on the chip coil shown in FIG. 1.

After the first layer 17 is formed, the lead wire 9 is folded back toward the electrode 4*a*. In order to ensure a certain inductance, the lead wire 9 is wound over the first layer 17 by three turns to form a second layer 18, as shown in FIG. 4. The second layer 18 corresponds to an upper winding part in the present invention. The number of turns of the second layer 18 is not limited to three and the second layer 18 may include another number of turns. The second layer 18 preferably includes two to five turns in order to prevent the second layer 18 from being too far from the electrode 4*b* at the end-of-winding side.

Figure 5:
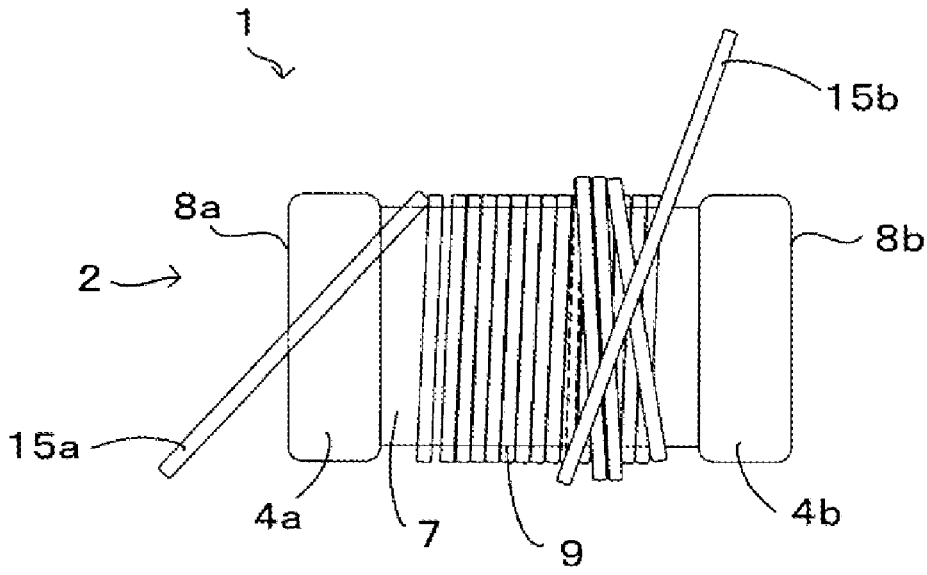
FIG. 5 is a diagram illustrating the winding process of the lead wire on the chip coil shown in FIG. 1.
Figure 6:
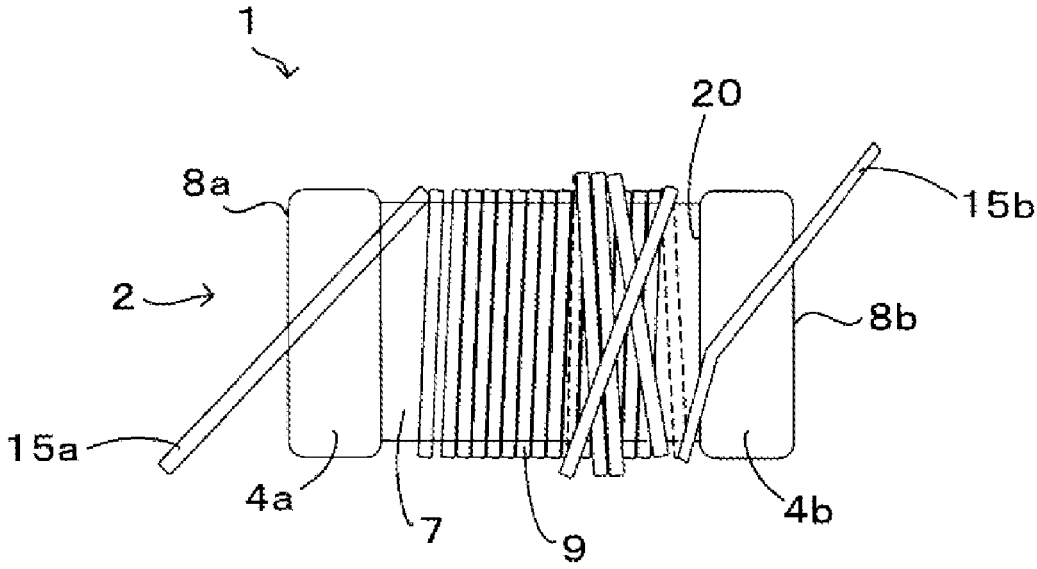
FIG. 6 is a diagram illustrating the winding process of the lead wire on the chip coil shown in FIG. 1.
Figure 7:
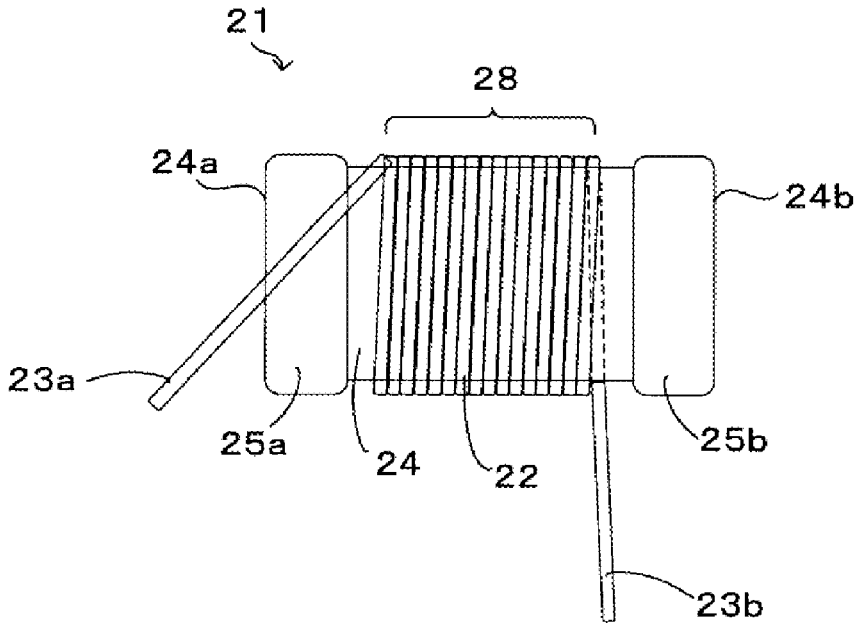
FIG.7 Prior Art
FIG. 7 is a diagram illustrating a winding process of a lead wire on a chip coil in related art.
Figure 8:
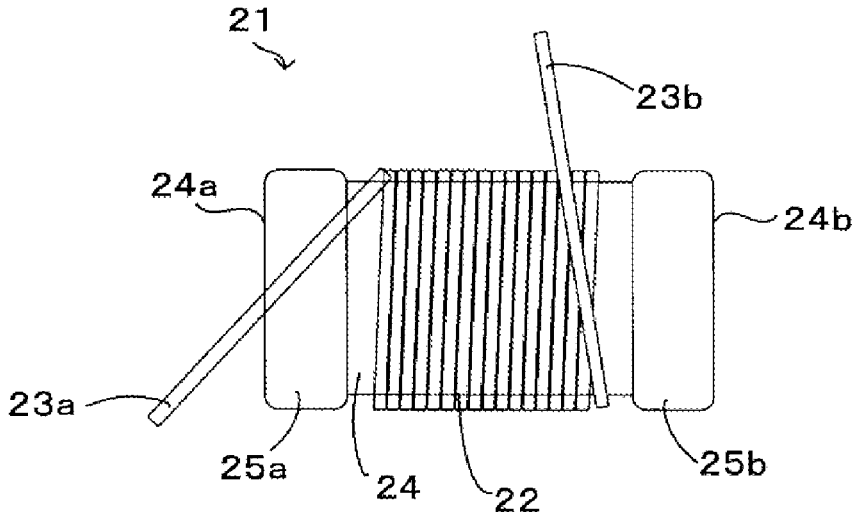
FIG.8 Prior Art
FIG. 8 is a diagram illustrating the winding process of the lead wire on the chip coil in the related art.
Figure 9:
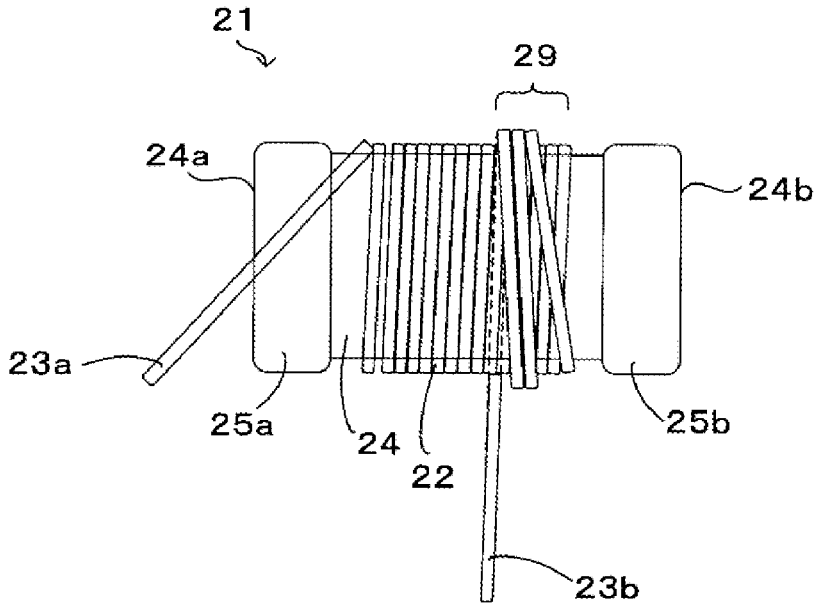
FIG.9 Prior Art
FIG. 9 is a diagram illustrating the winding process of the lead wire on the chip coil in the related art.

Next, as shown in FIG. 5, the lead wire 9 is folded back toward the electrode 4*b* at a predetermined folding-back position and is pulled toward the electrode 4*b* at the end-of-winding side so as to cross the second layer 18. Then, as shown in FIG. 6, the lead wire 9 is wound around the above-described portion which is between the end-of-winding part of the first layer 17 and the collar 8*b* and where the winding core 7 is bare. The lead wire 9 is caught at a bottom part 20 of the collar 8*b* to form a final terminal part 15*b*. At this time, the number of turns of the winding around the winding core 7 from the position where the lead wire 9 is folded back to the position where the lead wire 9 is caught at the bottom part 20 of the collar 8*b* is about one.

Then, the end 15*a* at the start-of-winding side of the lead wire 9 and the final terminal part 15*b* are heated by a heater while the end 15*a* at the start-of-winding side of the lead wire 9 is being pressed toward the electrode 4*a* and the final terminal part 15*b* is being pressed toward the electrode 4*b*. The electrode 4*a* and the electrode 4*b* made of tin are molten, the coating of the ends 15*a* and 15*b* of the lead wire 9 is stripped due to the heat, and the end 15*a* of the lead wire 9 is press-bonded for fixing to the electrode 4*a* and the end 15*b* thereof is press-bonded for fixing to the electrode 4*b*.

The number of turns of the winding around the winding core 7 from the position where the lead wire 9 is folded back to the position where the lead wire 9 is caught at the bottom part 20 of the collar 8*b* is not limited to one and the lead wire 9 may be wound around the winding core 7 by another number of turns. For example, when the winding core 7 has a quadrangular prism shape, as in the exemplary embodiments, the lead wire 9 can be folded back at one corner part of the quadrangular prism, can be wound by one quarter turn, and can be caught at another corner part of the quadrangular prism to be subjected to the thermo compression bonding to the electrode 4*b*. Winding the lead wire 9 by a number of turns that is a multiple of one quarter allows the lead wire 9 to be caught at another corner part of the quadrangular prism of the winding core 7. The lead wire 9 is made more difficult to be uncoiled with the increasing number of turns of the winding around the winding core 7 from the position where the lead wire 9 is folded back to the position where the lead wire 9 is caught at the bottom part 20 of the collar 8*b*.

Next, the end 15*a* and the final terminal part 15*b* of the lead wire 9 are processed to have shorter lengths (see FIG. 2) and the formation of the winding part 3 is finished. Then, the resin layer 5 is formed over the winding part 3 and the collars 8*a* and 8*b* using the UV cured resin to complete the chip coil 1. The material of the resin layer 5 is not limited to the UV cured resin and may be made of another non-conductive resin.

As described above, according to the embodiments, since the lead wire 9, which is folded back toward the electrode 4*b* at the end-of-winding side and is wound, is caught at the bottom part 20 of the collar 8*b* to form the final terminal part 15*b*, it is possible to tighten the lead wire 9 between the position where the lead wire 9 is folded back and the position where the lead wire 9 is caught at the bottom part 20 of the collar 8*b* in the state in which the lead wire 9 is tensioned for fixing. Accordingly, the lead wire 9 is made difficult to be uncoiled to prevent the winding slack and the error in product specification dimension due to the winding slack. In addition, it is possible to prevent the lead wire 9 from being broken by a stress that is applied to the lead wire 9 at the part where the winding slack occurs.

Furthermore, since the final terminal part 15*b* is formed by catching the lead wire 9 at the bottom part 20 of the collar 8*b*, the lead wire 9 is wired from the bottom part 20 of the collar 8*b* to the electrode 4*b* to shorten the wiring distance from the position where the lead wire 9 is caught at the bottom part 20 of the collar 8*b* to the electrode 4*b*. Accordingly, the wired lead wire 9 is made difficult to be uncoiled in the direction of the folding-back position and, thus, it is possible to prevent terminal disconnection failures including the insufficient arrangement of the lead wire 9 to be subjected to the thermocompression bonding on the electrode 4*b* and/or the disconnection of the lead wire 9 that has been subjected to the thermocompression bonding from the electrode 4*b*.

The present invention is not limited to the above embodiments and various modifications can be made without departing from the spirit of the present invention.

For example, although the number of turns of the winding around the winding core 7 from the position where the lead wire 9 is folded back to the position where the lead wire 9 is caught at the bottom part 20 of the collar 8*b* is one in the above exemplary embodiments, the lead wire 9 can be wound by at least one quarter turn from the folding-back position when the winding core 7 has a quadrangular prism shape. In this case, after the lead wire is folded back at one corner part of the quadrangular prism of the winding core 7, the lead wire can be caught at another corner part to tighten the lead wire in the state in which the lead wire is tensioned and can be caught at the bottom part 20 of the collar 8*b* for fixing. Consequently, it is possible to prevent the winding slack of the lead wire 9.

Although the winding core 7 has a quadrangular prism shape in the above exemplary embodiments, the winding core 7 can have a column shape. When the winding core 7 has a column shape, the lead wire 9 can be wound by about one turn from the folding-back position to be caught at the bottom part 20 of the collar 8*b*. In this case, the lead wire 9 can be wound around the column-shaped winding core 7 from the part where the lead wire 9 is folded back, can be tightened in the state in which the lead wire 9 is tensioned, and can be caught at the bottom part 20 of the collar 8*b* for fixing. Consequently, it is possible to prevent winding slack in the lead wire 9 even when the winding core 7 has a column shape, as in the case in which the winding core 7 has a quadrangular prism shape.

Although the lead wire 9 is horizontally wound in a direction that is parallel to the mounting board in the above embodiments, the lead wire 9 may be vertically wound in a direction that is perpendicular to the mounting board.

In an embodiment consistent with the disclosure, because the lead wire is folded back toward the other electrode and is wound and caught at the bottom part of the collar to form the final terminal part, it is possible to tighten the lead wire between the position where the lead wire is folded back and the position where the lead wire is caught at the bottom part of the collar in a state in which the lead wire is tensioned for fixing. Accordingly, it is difficult for the lead wire to uncoil, which prevents winding slack and error in product specification dimension due to the winding slack. In addition, it is possible to prevent the lead wire from being broken by a stress that is applied to the lead wire at the part where the winding slack occurs.

Additionally, because the final terminal part is formed by catching the lead wire at the bottom part of the collar, the lead wire is wired, or wound from the bottom part of the collar to the electrode to shorten the wiring distance from the position where the lead wire is caught at the bottom part to the electrode. Accordingly, it is difficult for the wired lead wire to uncoil in the direction of the folding-back position. Hence, it is possible to prevent terminal disconnection failures that include insufficient arrangement of the lead wire that is to be bonded by thermocompression on the electrode and/or disconnection of the lead wire from the electrode.

In another embodiment, the winding core has a quadrangular prism shape and the lead wire is wound by at least one quarter turn from the folding-back position. Accordingly, after the lead wire is folded back at one corner part of the quadrangular prism of the winding core, the lead wire can be caught at another corner part to tighten the lead wire in the state in which the lead wire is tensioned and can be caught at the bottom part of the collar for fixing. Consequently, it is possible to prevent the winding slack of the lead wire.

According to another embodiment, the winding core has a column shape and the lead wire is wound by about one turn from the folding-back position. Accordingly, the lead wire can be wound around the column-shaped winding core from the part where the lead wire is folded back, can be tightened in the state in which the lead wire is tensioned, and can be caught at the bottom part of the collar for fixing. Consequently, it is possible to prevent the winding slack of the lead wire.

Embodiments of the disclosure are applicable to a multi-winding electronic component used for noise reduction or an impedance matching circuit.

It should be understood that the above-described embodiments are illustrative only and that variations and modifications will be apparent to those skilled in the art without departing from the scope and spirit of the disclosure. The scope of the present invention should be determined in view of the appended claims and their equivalents.

The invention claimed is:

1. A method of winding a lead wire on a multi-winding electronic component that includes a winding core, collars at both ends of the winding core, electrodes on the collars at first and second sides of the winding core and a lead wire wound around the winding core, the method comprising:

winding the lead wire around the winding core from the first side towards the second side to form a lower winding part;

forming an upper winding part in which the lead wire is wound over the lower winding part in a direction from the second side to the first side by a number of turns that is smaller than a total number of turns of the lead wire in the lower winding part;

folding back the lead wire at a predetermined folding-back position toward the second side and winding the lead wire over the upper winding part; and catching the lead wire folded back at the folding-back position at a bottom part of the collar on which one of the electrodes is formed on the winding core to form a final terminal part.

2. The method of winding the lead wire on the multi-winding electronic component according to claim 1, wherein the winding core has a quadrangular prism shape.

3. The method of winding the lead wire on the multi-winding electronic component according to claim 2, wherein the lead wire is wound by at least one quarter turn from the predetermined folding-back position.

4. The method of winding the lead wire on the multi-winding electronic component according to claim 2, wherein the lead wire is wound by about one turn from the predetermined folding-back position.

5. The method of winding the lead wire on the multi-winding electronic component according to claim 1, wherein the lead wire is wound by at least one quarter turn from the predetermined folding-back position.

6. The method of winding the lead wire on the multi-winding electronic component according to claim 1, wherein the winding core has a column shape.

7. The method of winding the lead wire on the multi-winding electronic component according to claim 1, wherein the lead wire is wound by about one turn from the predetermined folding-back position.

8. The method of winding the lead wire on the multi-winding electronic component according to claim 1, further comprising, prior to catching the lead wire, winding the lead wire around a portion of the winding core between an end-of-winding part of the lower winging part and the collar at the second end where the winding core is bare.

* * * * *